US011885189B2

(12) United States Patent
Robertson

(10) Patent No.: US 11,885,189 B2
(45) Date of Patent: Jan. 30, 2024

(54) RADIAL CUTTING APPARATUS FOR CUTTING A DOWNHOLE CONDUIT

(71) Applicant: Robertson Intellectual Properties, LLC, Mansfield, TX (US)

(72) Inventor: Michael C. Robertson, Mansfield, TX (US)

(73) Assignee: Robertson Intellectual Properties, LLC, Mansfield, TX (US)

( * ) Notice: Subject to any disclaimer, the term of this patent is extended or adjusted under 35 U.S.C. 154(b) by 0 days.

(21) Appl. No.: 17/840,356

(22) Filed: Jun. 14, 2022

(65) Prior Publication Data

US 2022/0397011 A1 Dec. 15, 2022

Related U.S. Application Data

(60) Provisional application No. 63/210,834, filed on Jun. 15, 2021.

(51) Int. Cl.
*E21B 29/02* (2006.01)
*E21B 31/16* (2006.01)

(52) U.S. Cl.
CPC ..... *E21B 29/02* (2013.01); *E21B 31/16* (2013.01)

(58) Field of Classification Search
CPC ..... E21B 29/02; E21B 31/16
See application file for complete search history.

(56) References Cited

U.S. PATENT DOCUMENTS 2,935,944 A * 5/1960 Sweetman ..... B26F 3/04 102/500
4,298,063 A * 11/1981 Regalbuto ..... E21B 29/02 102/308
4,352,397 A * 10/1982 Christopher ..... E21B 29/02 149/44
4,446,920 A * 5/1984 Woytek ..... E21B 43/114 166/55
4,598,769 A * 7/1986 Robertson ..... E21B 29/02 166/55

* cited by examiner

*Primary Examiner* — Christopher J Sebesta
(74) *Attorney, Agent, or Firm* — McCutcheon Joseph, PLLC

(57) ABSTRACT

A severing apparatus is used for severing a conduit. The apparatus includes a main body section having an upper portion, a lower portion, and an intermediate portion. A combustible charge is located in the intermediate portion, and an ignition mechanism is coupled to the upper portion for igniting the combustible charge. A nozzle head is located in the lower portion and includes an internal cavity and a nozzle portion having apertures at spaced apart positions for providing passages from the internal cavity to outside of the nozzle head. The ignition mechanism is configured to ignite the combustible charge to create a flame and combustion products and pressure in the internal cavity for moving the nozzle head relative to the lower portion so that the nozzle portion protrudes out of the lower portion for passage of the flame and hot combustion products out of the apertures to sever the conduit.

20 Claims, 3 Drawing Sheets

Fig. 2
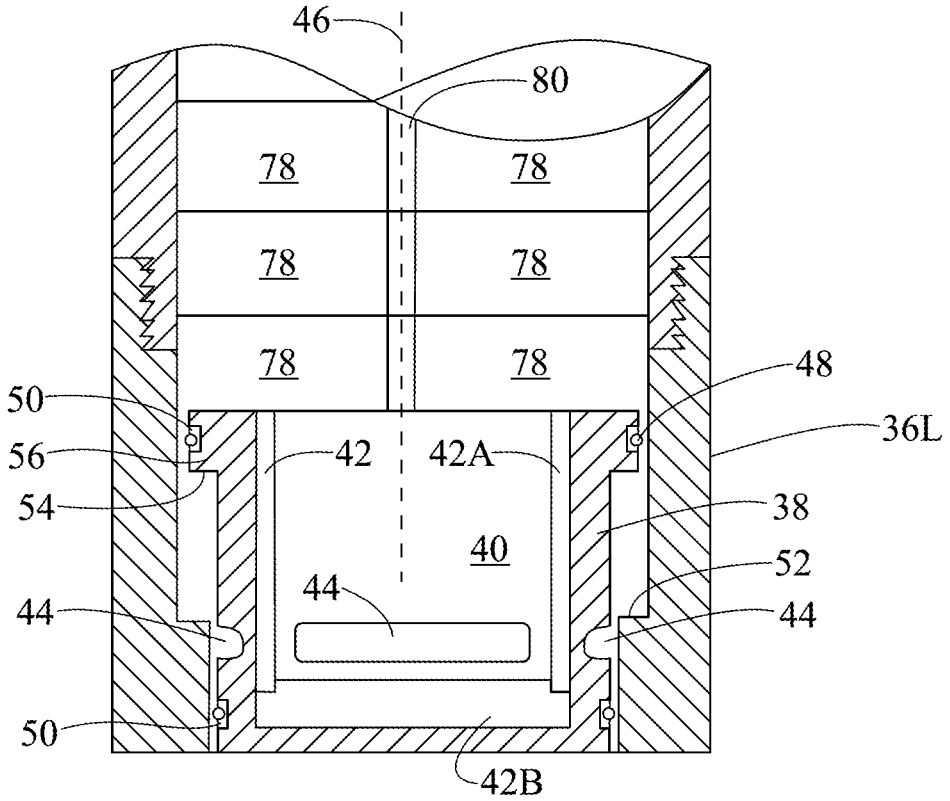
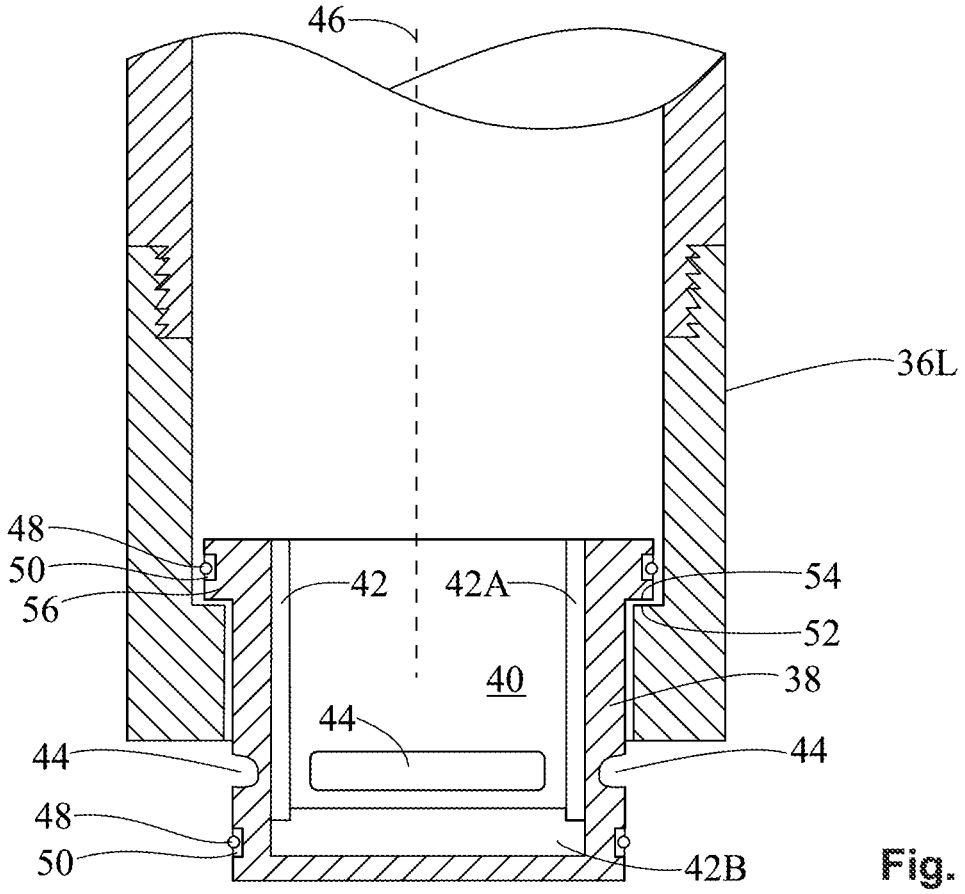
Fig. 3

RADIAL CUTTING APPARATUS FOR CUTTING A DOWNHOLE CONDUIT

CROSS REFERENCE TO RELATED APPLICATIONS

The present application is a non-provisional patent application that claims priority to U.S. Provisional Patent Application No. 63/210,834, having the title of "Radial Cutting Apparatus for Cutting a Downhole Conduit," filed on Jun. 15, 2021. The disclosure of the prior application is hereby incorporated by reference herein in its entirety.

FIELD

The present invention relates, generally, to an apparatus and methods for cutting or severing a conduit located in a borehole formed in the earth. In particular, the invention relates to a radial cutting apparatus for cutting, perforating or severing a conduit.

BACKGROUND

During drilling operations of an oilfield well, a drill pipe may become stuck in the borehole of the well. In such a case, remedial action is required to remove an upper portion of the drill pipe, so that the lower portion of the drill pipe can be drilled out.

Existing cutting and severing apparatus have experienced problems with the clogging of the apertures of the nozzles or the lack of uniformity of the cutting or severing procedure. To avoid these problems, separate mixing chambers and other structural features have been added to the cutting and severing apparatus, which creates complexity in the operation of the apparatus and adds significant weight to the apparatus when operating downhole.

A need exists for apparatus and methods for cutting or severing a conduit, located downhole in a borehole formed in the earth, which eliminate any clogging of the nozzles and lack of uniformity in the cutting and severing procedures, as well as provides a more simple operation of the cutting and severing apparatus.

The present invention meets these needs.

SUMMARY

One object of the present disclosure is to provide a new and useful apparatus for cutting, perforating or severing a conduit, wherein the conduit can be located within a borehole formed in the earth. The conduit may be a drill pipe, production tubing, coiled tubing, casing, or other tubular. The apparatus of the present disclosure comprises a non-explosive fuel type for use in cutting or severing at least one conduit and, therefore, provides a non-explosive solution to the pipe recovery process.

In an embodiment, the apparatus may comprise a main body section comprising a central axis, an upper portion, a lower portion, and an intermediate portion between the upper portion and the lower portion, and the main body section can be adapted to be inserted into the conduit. A combustible charge is located in the intermediate portion. An ignition mechanism can be coupled to the upper portion for igniting the combustible charge, which can comprise a pyrotechnic charge or a plurality of pyrotechnic charges. The lower portion of the main body can comprise an internal no-go shoulder. A nozzle head can be located in the lower portion and adjacent the combustible charge. The nozzle head can comprise an internal cavity and a nozzle portion, including a plurality of apertures at spaced apart positions located around the central axis for providing passages from the internal cavity to outside of the nozzle head. In an embodiment, the nozzle head can comprise at least one seal around a perimeter of the nozzle head. Further, the nozzle portion can include any numbers of apertures, including in an embodiment, three or more apertures forming a plurality of apertures. In an embodiment, each of the plurality of apertures can be elongated in a direction perpendicular to the central axis. The apparatus further includes an ignition mechanism, which can be configured to ignite the combustible charge to create a flame and combustion products, as well as pressure in the internal cavity, for moving the nozzle head relative to the lower portion so that the nozzle portion protrudes out of the lower portion for passage of the flame and hot combustion products out of the plurality of apertures, to sever the conduit.

In an embodiment, the nozzle head can comprise an outer shoulder that can be configured to contact the internal no-go shoulder, of the lower portion, after the ignition mechanism ignites the combustible charge to move the nozzle head relative to the lower portion of the main body section. Further, in an embodiment, the outer shoulder can be located on a radially protruding portion of the nozzle head, and the at least one seal can be located on the radially protruding portion of the nozzle head, as well.

In another embodiment, a method for severing a conduit includes inserting a severing apparatus into the conduit, wherein the severing apparatus can comprise a combustible charge, an ignition mechanism for igniting the combustible charge, and a nozzle head located within a distal end portion of the severing apparatus. The combustible charge can be formed of one or more charges (e.g., pyrotechnic charge such as thermite) for producing an exothermic reaction, which are installed within the severing apparatus. The nozzle head can comprise a plurality of apertures for projection of combustion products. In an embodiment, a first nozzle head, usable for discharging a flame and hot combustion products, can be replaced by a second nozzle head after the first nozzle head has discharged the flame and the hot combustion products from the plurality of apertures of the first nozzle head. The second nozzle head can include the same or a different arrangement of nozzles as compared to the plurality of nozzles of the first nozzle head. The steps of the method can continue by igniting the combustible charge via the ignition mechanism to create the flame and the combustion products, as well as to create pressure in an internal cavity of the nozzle head to move the nozzle head at least partially out of the distal end of the severing apparatus, so that the plurality of apertures are exposed to the conduit. The steps of the method can further include discharging the flame and hot combustion products out of the plurality of apertures to sever the conduit.

In an embodiment, the distal end portion of the severing apparatus can comprise an internal no-go shoulder, and the nozzle head can comprise an outer shoulder, and the method steps can include preventing the nozzle head from completely exiting the distal end portion by contacting the internal no-go shoulder with the outer shoulder of the nozzle head, after the nozzle head is moved a predetermined distance relative to the distal end portion. In an embodiment, the method steps can include sealing the nozzle head in the distal end portion of the severing apparatus via at least one seal around the perimeter of the nozzle head.

BRIEF DESCRIPTION OF THE DRAWINGS

FIG. 2 is a cross-sectional close-up view of the nozzle head of the apparatus in a first position, according to an embodiment.

FIG. 3 is a cross-sectional close-up view of the nozzle head of the apparatus in a second position, according to an embodiment.

DETAILED DESCRIPTION

Figure 1:
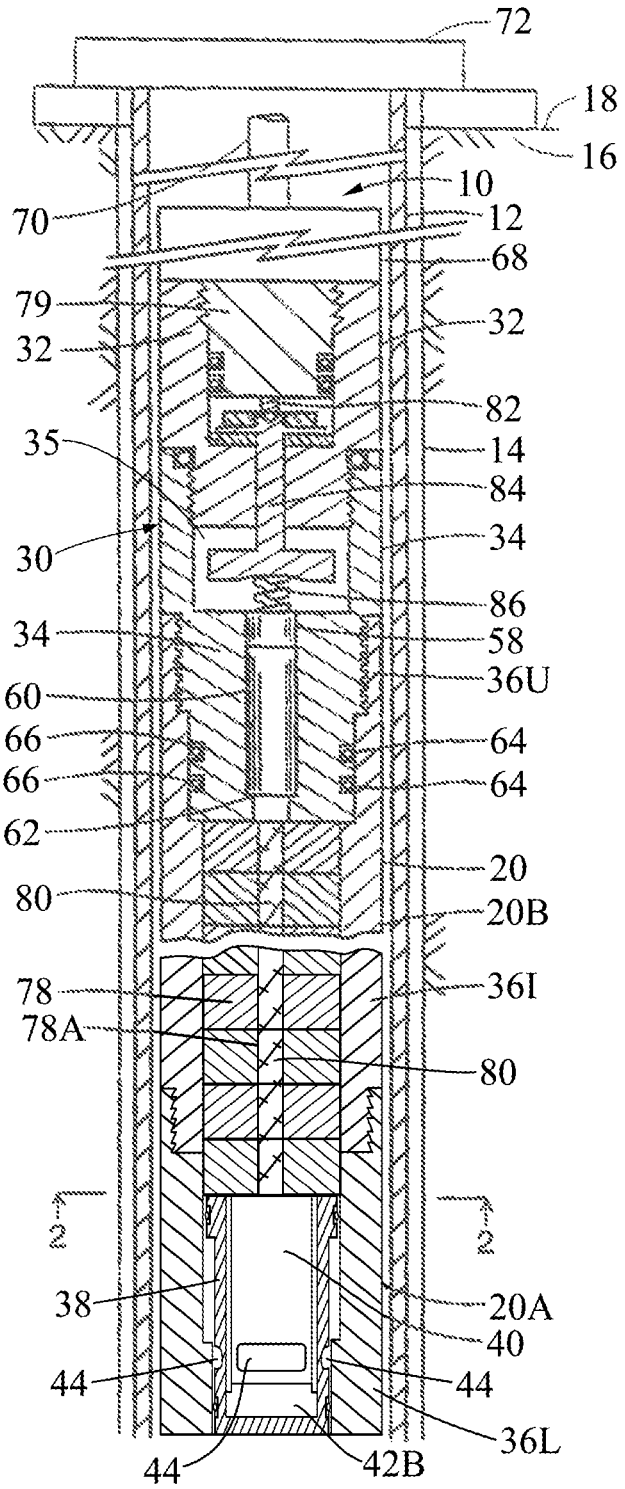
FIG. 1 is a cross-sectional view of the apparatus according to an embodiment.
Figure 4:
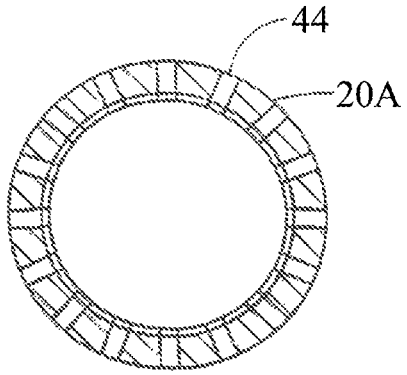
FIG. 4 is a cross-section of FIG. 1 taken along the lines 2-2 thereof.

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", "uphole", "downhole", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Referring now to the Figures, the apparatus, for cutting and severing conduit, of the invention is identified by reference numeral 10. It is shown located in metal drill pipe 12 located in a borehole 14 extending into the earth 16 from the surface 18. One of the purposes of the apparatus 10 is to cut or sever the drill pipe 12 in the event it becomes stuck in the borehole 14 to allow remedial action to take place. The drill pipe 12 is just one example of a conduit that may be cut or severed by the apparatus discussed herein. Other conduits that may be cut or severed by the disclosed apparatus include, but are not limited to, production tubing, coiled tubing, and casing.

The apparatus 10 comprises an annular metal wall 20 formed by annular metal sections 20A and 20B, and an ignition subassembly 30, which can comprise members 32 and 34 that can be screwed together as shown to form a chamber 35. The ignition subassembly 30 can comprise a lower portion 36L, an intermediate portion 361, and an upper portion 36U. The lower portion 36L includes a nozzle head 38 therein. The nozzle head 38 is provided with an internal cavity 40 that can be lined with a heat resistant liner 42 (See FIGS. 2 and 3) that may be formed of carbon, according to one embodiment. The liner 42 can comprise a cylindrical side wall 42A (see FIGS. 2 and 3) and a round bottom wall 42B (see FIGS. 1 and 2). A plurality of nozzle apertures 44 can be formed through the nozzle head 38 for providing passages from the internal cavity 40 to the outside of the nozzle head 38. The nozzle apertures 44 can be angularly spaced apart about a central axis 46 of the apparatus 10, as shown in FIGS. 2 and 3. Three nozzle apertures 44 are shown in FIGS. 1-3; however, two or four or more nozzle apertures 44 may be formed in the nozzle head 38. The nozzle apertures 44 may open in a plane perpendicular to the central axis 46, as shown in FIG. 2. In addition, the nozzle apertures may be elongated in a direction perpendicular to the central axis 46, as shown in FIG. 2.

As shown in FIGS. 2 and 3, the nozzle head 38 may further include seals, such as O-rings 48, located in respective slots 50 around a perimeter of the nozzle head 38. The seals 48 and liquid pressure in the internal cavity 40 initially hold the nozzle head 38 within the lower portion 36L of the apparatus 10, and shown FIGS. 1 and 2. Liquid from the borehole 14 can flow into the internal cavity 40 by way of the nozzle apertures 44 when the apparatus 10 is located in the borehole 14. The lower portion 36L of the apparatus 10 may include an internal no-go shoulder 52 for contact with an outer shoulder 54 on a radial protrusion 56 of the nozzle head 38 as shown in FIGS. 2 and 3. The outer shoulder 54 of the nozzle head 38 is configured to contact the internal no-go shoulder 52 after the nozzle head 38 is moved relative to the lower portion 36L during a cutting or severing operation, as discussed below.

Located in the intermediate portion 361 of the ignition subassembly 30 and supported by the nozzle head 38 is a fuel load. The fuel may in some embodiments be combustible material in the form of a solid, a liquid, or a gel. The combustible material may be non-explosive fuels such as thermites, modified thermites (containing gasification agents) or thermite mixtures containing binders, low explosives such as propellants and pyrotechnic compositions or modified liquid or gelled fuels with metal and/or metal oxide additives. In some embodiments, the non-explosive combustible fuels may be in the form of a single or multiple stacked combustible charges 78, e.g., thermite pellets. The pelletized fuel may be installed within the assembly prior to shipping. In other embodiments, the pelletized fuel may be installed in the assembly at the work site so that the mass of fuel can be adjusted to suit the specific well conditions, constraints, and operational requirements such as hydrostatic pressure or changes to the cutting requirements. Each of the combustible charges 78 may have a cylindrical outer surface and a central aperture 78A extending therethrough, and may be compressed into donut shaped pellets, as shown in FIGS. 1 and 2. The combustible charges 78 are stacked on top of each other within the annular section 20B, with the lowest combustible charge 78 supported by the nozzle head 38 and with the apertures 78A in alignment.

In an embodiment, loosely packed combustible material 80, which can be of the same material used in forming the combustible charges 78, can be located within the apertures 78A of the combustible charges 78, such that each combustible charge 78 is ignited from the loosely packed combustible material 80 upon ignition by an ignition mechanism 58.

Referring back to FIG. 1, the ignition mechanism 58 is supported in a central aperture 60 of the lower portion of member 34, of the ignition subassembly 30, by a shoulder 62 of member 34, which lower portion is screwed into the upper portion 36U of annular section 20B. The central aperture 60 may extend completely through the lower portion of member 34. Seals 64, such as O-rings, may be located in annular grooves 66 of the lower portion. The ignition mechanism 58 may comprise an electrical resistor (not shown) that is heated by an electrical current applied thereto from the surface 18.

Ignition subassembly member 32 may be coupled to a cable head assembly 68. A wireline cable 70 can be coupled to the upper end of the cable head assembly 68 and can extend to the surface 18 and a lifting apparatus 72. The lifting apparatus 72 may include a reel employed for unwinding and winding the wireline cable 70 to lower and raise the cutting apparatus 10. As shown schematically in FIG. 5, the lifting apparatus 72 may include a source 74 of electrical power for applying electrical current to the ignition mechanism 58 by way of electrically insulated lead 76H of the wireline cable 70. The electrically insulated lead 76R may be an electrically insulated ground or return lead coupled to the ignition mechanism 58. An uphole switch 99, shown schematically in FIG. 5, may be employed to couple and uncouple the source 74 to and from the ignition mechanism 58 to energize and de-energize the ignition mechanism 58. As shown in FIG. 1, the lead 76H may be electrically coupled to the ignition mechanism 58 by way of an electrode probe 79, a prong 82, a conductor 84, and a spring 86. The electrode probe 79, the prong 82, the conductor 84, and the spring 86 may be electrically insulated to prevent a short from occurring. This ignition system may be defined as an electric line firing system.

When the ignition mechanism 58 is energize by electrical current, it can generate enough heat to ignite the combustible material 80 and, hence the combustible charges 78, to generate a very high temperature flame with other hot combustion products and pressure in the internal cavity 40 that forces the nozzle head 38 downward from a first position within the lower portion 36L, as shown in FIG. 2, to a second position, as shown in FIG. 3, in which at least a portion of the nozzle head 38, having the nozzle apertures 44, protrudes out of the lower portion 36L. The nozzle apertures 44 in the second position are thus exposed to the drill pipe 12 for passage of the flame and hot combustion products out of the plurality of apertures 44 to cut or sever the drill pipe 12. In this position, the flame and hot combustion products flow out of the internal cavity 40 of the nozzle head 38 by way of the apertures 44 and to the pipe 12 to cut or sever the pipe 12 at the level of the apertures 44.

After the drill pipe 12 has been cut or severed, the apparatus 10 is removed from the borehole 14, allowing the upper portion of the drill pipe 12 to be removed, and the lower portion of the drill pipe 12 may then be drilled out in the event that the drill pipe 12 has become stuck in the borehole 14.

In one embodiment, the outside diameter of annular metal section 20B may be 1 inch, with two or more equally spaced apart apertures 44 around the central axis 46. The height of the apertures may be of about 0.060 to 0.100 inches. It is to be understood, however, that these specifications may vary.

Figure 5:
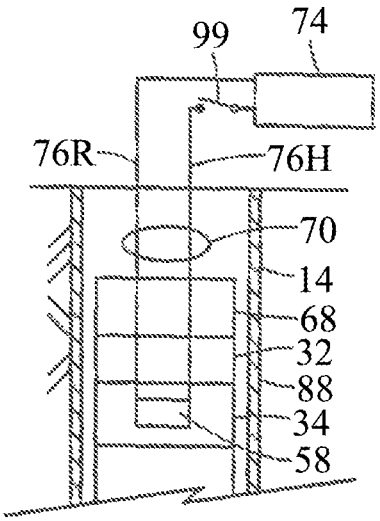
FIG. 5 schematically illustrates the electrical system of the apparatus of FIG. 1.

The apparatus 10 also may be used to cut or sever conventional metal production tubing, metal coiled tubing, or metal casing in a borehole for remedial purposes. In FIG. 5, the apparatus 10 shown is employed to cut or sever metal casing 88 located in the borehole 14.

A method for severing the drill pipe 12 may include the step of inserting the apparatus 10 into the drill pipe 12. The apparatus 10 may be the one described herein, e.g., comprising at least one combustible charge 78, an ignition mechanism 58 for uniting the combustible charge 78, and a nozzle head 38 located within a lower portion 36L (distal end portion) of the apparatus 10 and comprising a plurality of apertures 44. The steps of the method can continue by igniting the combustible charge 78, via the ignition mechanism 58, to create a flame and combustion products, and pressure in an internal cavity 40 of the nozzle head 38, to move the nozzle head 38 at least partially out of the lower portion 36L of the apparatus 10 so that the plurality of apertures 44 are exposed to the drill pipe 12. The steps of the method can further include discharging the flame and hot combustion products out of the plurality of apertures 44 to sever the drill pipe 12.

After the cutting process is complete and the apparatus 10 is removed from the borehole 14, the lower portion 36L of the apparatus 10, including the nozzle head 38, may be detached from the apparatus 10 and replaced with another lower portion 36L having another nozzle head. That is, the lower portion 36L may be detachably attached, e.g., by a threaded connection, to the intermediate portion 36I, so that the lower portion 36L may be easily detached from the intermediate portion 36I. The other nozzle head may be different than the original nozzle head 38 by having a different arrangement or pattern of nozzles. This process may be conducted at the well site or other locations. In other embodiments, the lower portion 36L may be detachably attached from the intermediate portion 36I in order to replace or modify the fuel load, i.e., the charges 78 and/or the combustible material 80. Replacing the lower portion 36L so that the apparatus 10 has a different nozzle head may be advantageous if the different nozzle head is more suited to a particular cutting operation. Similarly, detaching the lower portion 36L to replace or modify the fuel load may be advantageous if the different fuel load is more suited to a particular cutting operation. For instance, more donut shaped pellets (see charges 78 in FIGS. 1 and 2) may be added, or some of the existing pellets may be removed. Alternatively, at least some of the pellets may be removed and replaced with different pellets having a different composition than the existing pellets. The detachable lower portion 36L provides the apparatus 10 with a modularity that is beneficial when the apparatus 10 is already in the field, making the apparatus 10 adaptable to different cutting operations while in the field. For instance, the apparatus 10 may be part of a kit that includes a variety of lower portions 36L having different nozzle heads 38 that are attachable to the apparatus 10 via, e.g., a threaded connection. The kit may also include a variety of different pellets that may replace existing pellets, or that may otherwise be added or inserted into the intermediate portion 36I.

Figure 6:
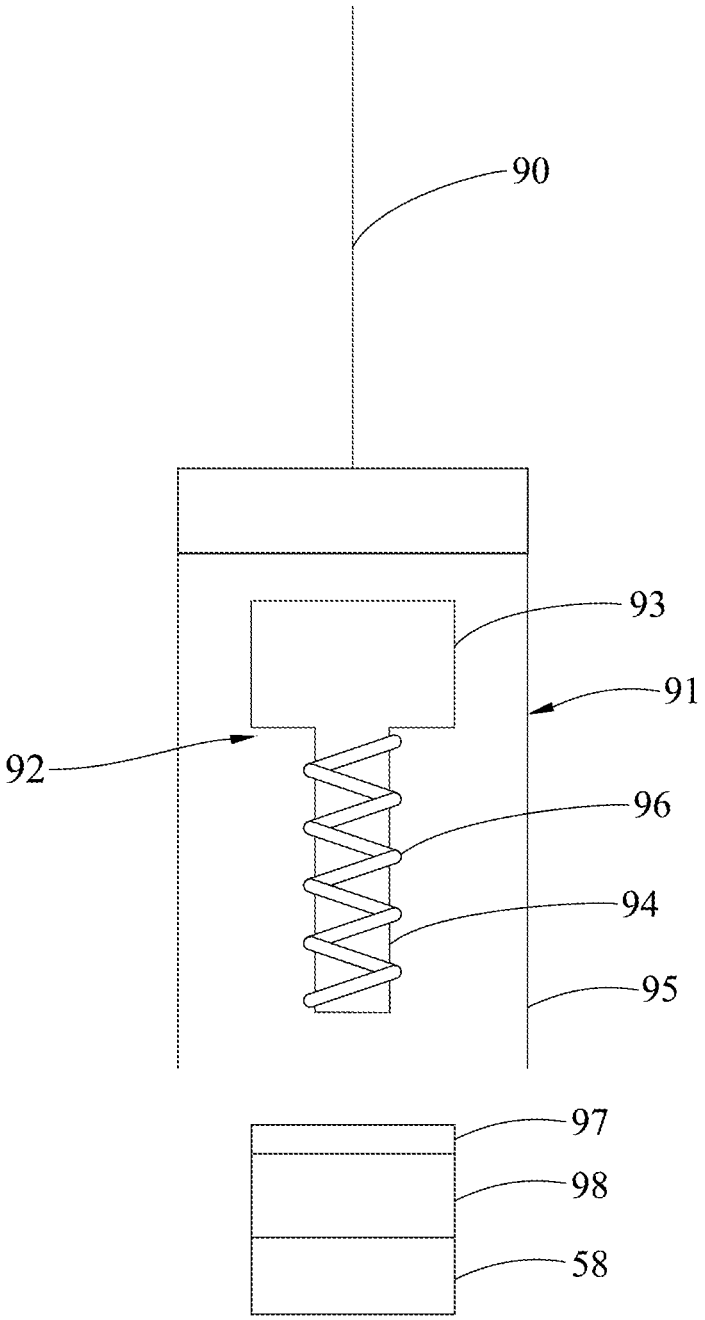
FIG. 6 schematically illustrates an electrical system according to another embodiment.

In another embodiment shown in FIG. 6, a slickline battery firing system may be employed in lieu of the electric line firing system to energize the ignition mechanism 58. This system may comprise a slickline cable connection 90 for supporting the modified apparatus 10 and which is connected to a pressure firing head 91. The pressure firing head 91 may comprise a metal piston 92 having a larger diameter head 93 with a smaller diameter metal rod 94 extending downward from the bottom of the larger diameter head 93. The piston 92 may be slidably located in a hollow cylinder 95. A spring 96 surrounding the rod 94 may be employed to provide upward pressure against the underside of the larger diameter head 93. The spring 96 can be adjustable to allow for hydrostatic compensation of well fluids so that the system does not fire at bottom hole pressure. When the piston 92 is moved downward, the lower end of the rod 94 will make contact with an electrical lead 97 from the battery pack 98 and electrical lead coupled to one side of the ignition mechanism 58 (the minus terminal of the battery pack 98 and the other side of the ignition mechanism 58 are grounded) to discharge current to the ignition mechanism 58 to ignite the material 80 and fire the combustible charges 78. Fluid ports can extend through the wall of the cylinder 95, above the larger diameter piston head 93. When the borehole apparatus is in place in the borehole and ready to cut the metal conduit, a pump, located at the surface, can be used to increase the fluid pressure in the conduit and move the piston 92 downward against the pressure of the spring 96 to allow the rod 94 to make electrical contact with the leads to fire the combustible charges 78.

In a further embodiment, a slickline percussion firing system may be employed in lieu of the electric line firing system to ignite the charges 78. This system may comprise a slickline cable head connection for supporting the modified apparatus 10 and which is connected to a pressure firing subassembly. The pressure firing subassembly comprises a cylinder having the piston and spring described in connection with the battery firing system. Ports are formed through the cylinder wall above the piston. Fluid pressure is increased, to force the piston rod (firing pin) against a lower percussion firing cap which ignites upon impact to ignite the charges 78.

In addition, a percussion firing system that is run via coiled tubing, production tubing, or drill pipe may be employed in lieu of the electric firing system to ignite the charges 78. This system may comprise coiled tubing for supporting the modified apparatus 10, which is connected to a connector subassembly that connects to a pressure firing head, which comprises a hollow cylinder with a piston located therein and supported by shear pins. The coiled tubing is coupled to the interior of the cylinder at its upper end. The piston has a central flow path extending axially downward from its upper end and then radially outward through the cylinder wall. A firing pin extends from the lower end of the piston. The flow path allows the coiled tubing to fill with water as the assembly is lowered downhole and also allows for circulation of fluid in running of the assembly. When the apparatus is at the desired cutting depth, a ball is dropped into the tubing which passes to the piston, plugging the flow path and allowing an increase in fluid pressure to be achieved in the tubing and upper end of the cylinder, which shears the shear pins and drives the firing pin into the percussion cap to ignite the charges 78.

While various embodiments usable within the scope of the present disclosure have been described with emphasis, it should be understood that within the scope of the appended claims, the present invention can be practiced other than as specifically described herein.

What is claimed is:

1. An apparatus for cutting or severing a conduit, comprising:

a main body section comprising a central axis, an upper portion, a lower portion, and an intermediate portion between the upper portion and the lower portion, the main body section adapted to be inserted into the conduit;

a combustible charge located in the intermediate portion;

an ignition mechanism coupled to the upper portion for igniting the combustible charge; and a nozzle head located in the lower portion and adjacent the combustible charge, wherein the nozzle head comprises an internal cavity and a nozzle portion including a plurality of apertures at spaced apart positions located around the central axis for providing passages from the internal cavity to outside of the nozzle head, wherein the ignition mechanism is configured to ignite the combustible charge to create a flame and combustion products and pressure in the internal cavity for moving the plurality of apertures and the nozzle head relative to the lower portion so that the plurality of apertures and the nozzle portion protrude out of the lower portion for passage of the flame and combustion products out of the plurality of apertures to sever the conduit.

2. The apparatus of claim 1, wherein the combustible charge comprises one or more pyrotechnic charges.

3. The apparatus of claim 1, wherein the combustible charge comprises one or more solid combustible materials.

4. The apparatus of claim 1, wherein the lower portion comprises an internal no-go shoulder, and the nozzle head comprises an outer shoulder that is configured to contact the internal no-go shoulder after the ignition mechanism ignites the combustible charge to move the nozzle head relative to the lower portion.

5. The apparatus of claim 4, wherein the nozzle head comprises at least one seal around a perimeter of the nozzle head.

6. The apparatus of claim 5, wherein the outer shoulder is located on a radially protruding portion of the nozzle head, and the at least one seal is located on the radially protruding portion.

7. The apparatus of claim 1, wherein the combustible charge comprises a metal and an oxidizer.

8. The apparatus of claim 1, wherein each of the plurality of apertures is elongated in a direction perpendicular to the central axis.

9. The apparatus of claim 1, wherein the combustible charge is a modified thermite or a thermite mixture.

10. The apparatus of claim 9, wherein the thermite mixture comprises at least one of a binder, a pyrotechnic composition, a modified liquid fuel, and a modified gelled fuel.

11. A method for cutting or severing a conduit, comprising:

inserting a cutting or severing apparatus into the conduit, the cutting or severing apparatus comprising a fuel, an ignition mechanism for igniting the fuel, and a nozzle head located within a distal end portion of the cutting or severing apparatus and comprising a plurality of apertures;

igniting the fuel via the ignition mechanism to create a flame and combustion products and pressure in an internal cavity of the nozzle head to move the plurality of apertures and the nozzle head at least partially out of the distal end of the cutting or severing apparatus so that the plurality of apertures are exposed to the conduit; and discharging the flame and hot combustion products out of the plurality of apertures to sever the conduit.

12. The method of claim 11, wherein the fuel is foimed of one or more pyrotechnic charges that are installed within the cutting or severing apparatus.

13. The method of claim 11, wherein the distal end portion comprises an internal no-go shoulder, and the nozzle head comprises an outer shoulder, and the outer shoulder contacts the internal no-go shoulder after the nozzle head is moved a predetermined distance relative to the distal end portion to prevent the nozzle head from completely exiting the distal end portion.

14. The method of claim 11, wherein the nozzle head is a first nozzle head, and the method further comprises replacing the first nozzle head with a second nozzle head after discharging the flame and hot combustion products from the plurality of apertures of the first nozzle head.

15. The method of claim 14, wherein the second nozzle head includes a different arrangement of nozzles than the plurality of nozzles of the first nozzle head.

16. The method of claim 14, further comprising sealing the second nozzle head in the distal end portion of the severing apparatus via at least one seal around a perimeter of the second nozzle head.

17. The method of claim 11, wherein the fuel comprises a combustible material in the form of a solid, a liquid or a gel.

18. The method of claim 11, wherein the fuel comprises a metal and an oxidizer.

19. The method of claim 11, wherein the fuel is a modified thermite or a thermite mixture.

20. The method of claim 19, wherein the thermite mixture comprises at least one of a binder, a pyrotechnic composition, a modified liquid fuel, and a modified gelled fuel.

* * * * *